United States Patent [19]

Koll

[11] 4,329,570

[45] May 11, 1982

[54] LEAD CALCULATOR

[75] Inventor: Laurel A. Koll, Ruleville, Miss.

[73] Assignee: LeadRite Corporation, Ruleville, Miss.

[21] Appl. No.: 11,673

[22] Filed: Feb. 12, 1979

[51] Int. Cl.[3] ..... G06C 27/00

[52] U.S. Cl. ..... 235/78 R; 235/70 A; 235/88 R

[58] Field of Search ..... 235/70 R, 70 A, 70 C, 235/78 N, 79.5, 84, 78 R–78 M, 88 R–88 RC; 33/261

[56] References Cited

U.S. PATENT DOCUMENTS

| | | | |
|---|---|---|---|
| 1,001,061 | 8/1911 | Michaelson | 235/70 A |
| 1,421,553 | 7/1922 | Pohl | 33/261 |
| 1,536,693 | 5/1925 | Schneider | 235/88 M |
| 2,056,469 | 10/1936 | King | 33/261 |
| 2,168,056 | 8/1939 | Bernegau | 235/70 R |
| 2,170,144 | 8/1939 | Kells et al. | 235/70 R |
| 2,285,722 | 6/1942 | Kells et al. | 235/70 R |
| 2,303,018 | 11/1942 | Bucklin | 235/70 A |
| 2,439,209 | 4/1948 | Halsey | 235/84 |
| 2,591,058 | 4/1952 | Freeman | 235/84 |
| 2,815,172 | 12/1957 | Van Arsdale, Jr. et al. | 235/70 R |
| 3,133,353 | 5/1964 | Williams | 33/261 |
| 3,178,824 | 4/1965 | Cullihoe | 33/261 |
| 3,569,994 | 3/1971 | Rau | 235/78 N |
| 3,693,873 | 9/1972 | Otte | 235/88 N |
| 3,716,702 | 2/1973 | Hopcoogst | 235/70 R |
| 3,843,048 | 10/1974 | Haase | 235/88 M |
| 4,112,583 | 9/1978 | Castilla | 33/261 |
| 4,120,451 | 10/1978 | Stapleton | 235/89 R |
| 4,121,759 | 10/1978 | Markel et al. | 235/70 A |

*Primary Examiner*—L. T. Hix
*Assistant Examiner*—Benjamin R. Fuller
*Attorney, Agent, or Firm*—Larry S. Nixon

[57] ABSTRACT

A calculating device and a method of use thereof for determining the lead required to shoot a projectile at a moving target including cooperating logarithmic scales with indicia corresponding to the parameters target speed, range, projectile speed and lead displayed on a fixed and a slide member. Pictorial markers representative of various projectiles are disposed along the projectile velocity scale at locations corresponding to their normal speed and words descriptive of target speed are disposed at appropriate locations along the target speed scale so that calculations may be made by persons not having knowledge of game and projectile speeds in numerical terms. In accordance with one embodiment of the invention, the logarithmic scales are longitudinally disposed and the slide member may move relative to the fixed member in a horizontal direction. In accordance with other embodiments of the invention, the scales are disposed in a circular arc on members which may be rotated about a common axis.

22 Claims, 17 Drawing Figures

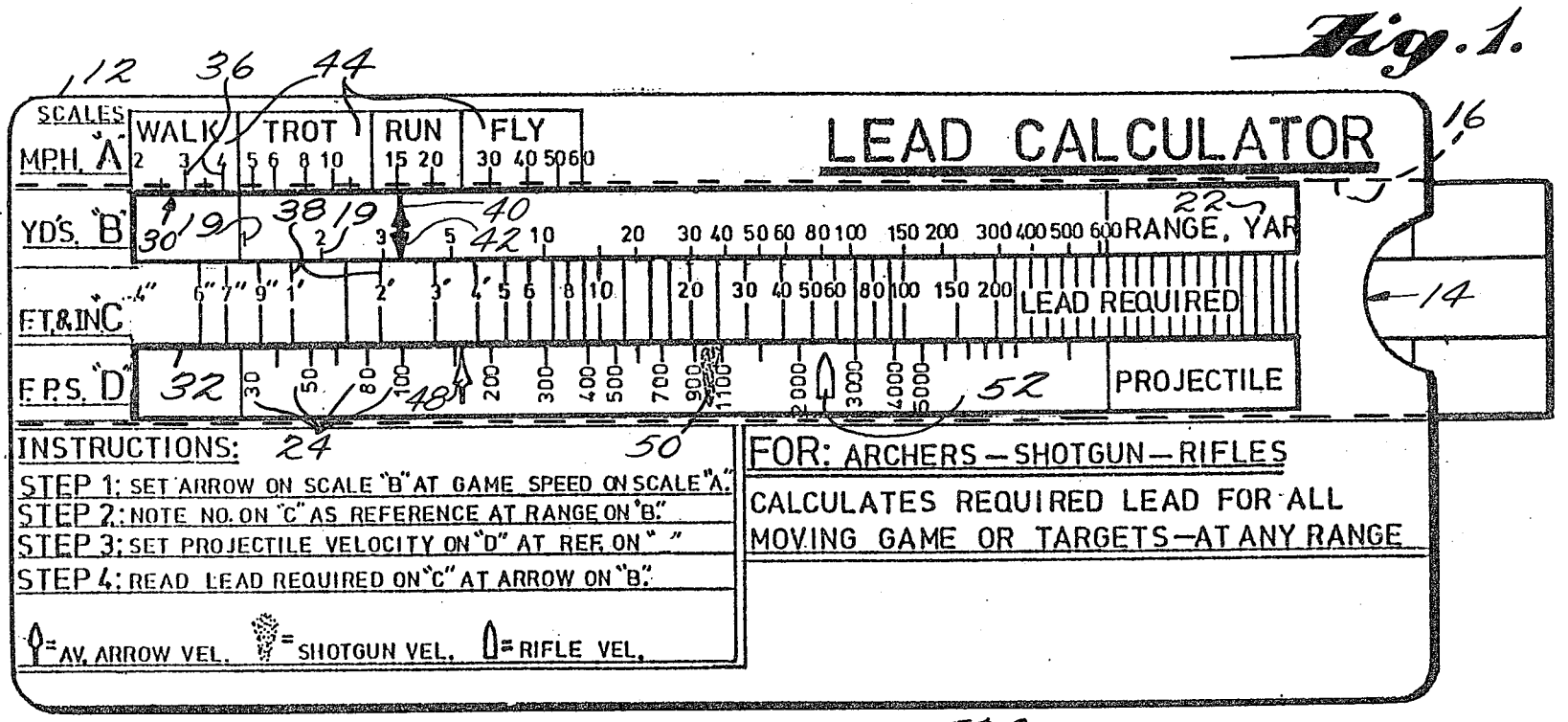
Fig. 1.
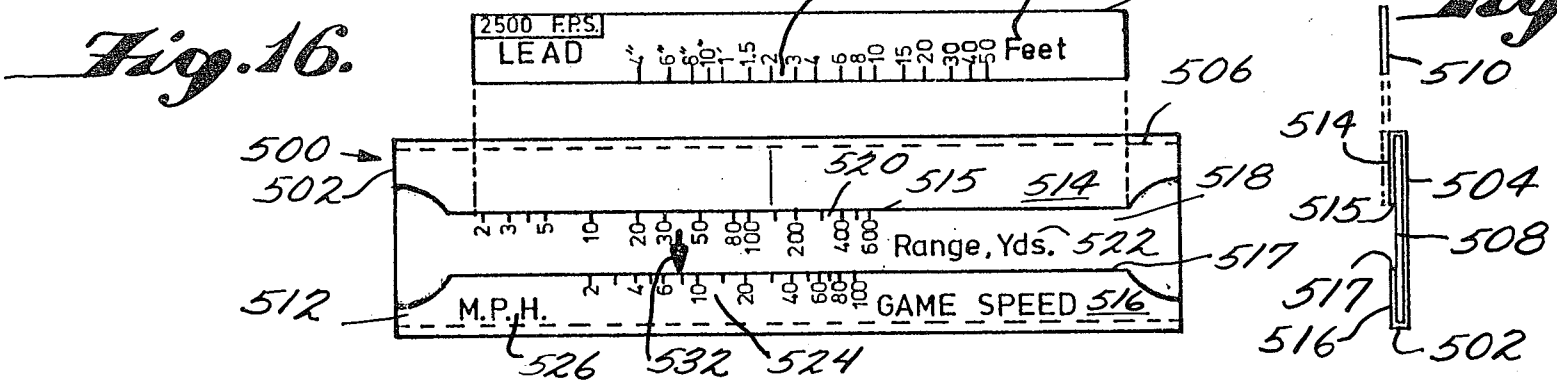
Fig. 16.
Fig. 17.

LEAD CALCULATOR

BACKGROUND AND BRIEF SUMMARY OF THE INVENTION

The invention relates to determining the lead required in shooting a projectile at a moving target and more particularly to a slide calculator for making such a determination.

It is well known that in order to hit a moving target such as skeet or game with a projectile, the projectile must be directed at a point ahead of the target location at the time the projectile is released. (The term "target" as used herein is intended to describe any moving object, living or inanimate, at which a shooter is aiming and therefore includes game.) The required distance ahead of the target is known as "lead" and the required amount of lead may be calculated from a knowledge of the directed velocity of the target, the directed velocity of the projectile and the distance from the shooter to the target at the time of shooting. The general formula for lead as a function of these variables is quite complex. However, for many applications a good approximation of the lead may be calculated by assuming that the velocity of the target and the projectile remain constant in magnitude and direction and that the distance from the shooter to the target does not change during the time of flight of the projectile. The later approximation is unnecessary if the distance measurement utilized is that from the shooter to the target at the time the projectile reaches the target. With these approximations the lead is given by the following formula:

$$L=(St\times D)/Sp$$

where

St = target speed

Sp = projectile speed

D = distance to target

In order that the formula be accurately applied the shooter must be able to estimate leads for the range of target speeds, target ranges and projectile speeds which he is likely to encounter. Leads appropriate for different circumstances may be learned with the use of the above formula. However, for many persons use of the formula may be difficult and overly time consuming. Its direct use requires a knowledge of mathematics which many shooters do not have. Furthermore, while this formula appears to be simple enough its use requires that all of the speed and distance values be expressed in the same units of speed and distance. However, it is common in the English-speaking nations to think of the speed of a target such as skeet or game in miles per hour, to think of range in yards, and to express firearm projectile velocities in feet per second. A shooter, thinking of speeds and distance in these units of measurement must first convert target speed to feet per second and range to feet, before calculating the lead in units of feet by use of the mathematical formula. This requirement substantially increases the difficulty and time required for the calculation. Another problem in determining lead encountered by many shooters, especially inexperienced game hunters is to relate the type of motion of game (e.g., walk, trot, run, fly) to a particular speed of the game or to relate the type of projectile being fired (e.g. arrow, shotgun pellets, rifle bullet) to the speed of the projectile.

These difficulties may be overcome by use of the present invention. In accordance with the principal embodiments of the invention, cooperating logarithmic scales with indicia corresponding to the parameters target speed, range, projectile speed and lead are horizontally or circularly displayed on a horizontal or circular slide rule type device, the particular indicia and scale units being those most commonly known for the particular parameter. In three embodiments of the invention the target speed and target range scales are disposed on the fixed member; the projectile speed and lead scales are disposed on the movable slide member. In a fourth embodiment all of these scales are disposed on the fixed member and a separate reference scale is disposed on the slide member. Calculation of required lead is ordinarily accomplished in two slide steps. The target speed is first multiplied by the range and the result is divided by the projectile speed to obtain the required lead as will be more fully explained in the detailed description below. In this way the required speed may be quickly and easily calculated without any conversion of units and requirements or mathematical knowledge. The calculation may of course also be made by dividing the target range or target speed by the projectile speed first, before the multiplication step (provided the scales are appropriately rearranged).

The calculation in each of the embodiments may be used in a number of shooting situations. These include game hunting, and skeet or target shooting as well as in military applications such as in shooting at various moving military targets.

In accordance with another feature of the invention pictorial markers representative of various projectiles which are commonly utilized, e.g. arrows, shot and rifle bullets, are disposed along the projectile velocity scale at locations corresponding to their normal speed, so that the lead requirement for each of these projectiles may be calculated without knowledge of actual projectile speed.

In accordance with still another feature of the invention a verbal description of target (game) speed is disposed at appropriate locations along the target speed scale so that a game hunter need only know "mode" of movement, that game is, for example, "walking," "trotting," "running" or "flying," to be able to calculate (or at least estimate) required lead.

In many instances, where the projectile speed is known for a firearm which is repeatedly used, it is very useful to have a calculator specifically designed for calculating required lead for a single projectile speed, but requiring only one slide step to make the calculation. Such a fifth embodiment of the present invention will accomplish this result. In accordance with this embodiment, there are only three scales, two being disposed on a fixed member and one being disposed on a slide member. The two scales disposed on the fixed member are offset relative to each other by such an amount as corresponds to the particular projectile speed, thereby eliminating the requirement of a division step in the calculation of required lead. In accordance with another feature of the invention, one or more of the scales used in the fifth embodiment may be formed unattached to the fixed and slide members but may be removably attached to the fixed member by the user with an adhesive at a location corresponding to the projectile speed of his particular weapon. This embodiment of the invention could be made very small, for example 1" by 5", and could be mounted directly on the particular weapon for convenient use during a hunting situation.

BRIEF DESCRIPTION OF THE DRAWING

These and other features and advantages of the invention can be more easily understood from the following more detailed description taken in conjunction with the accompanying drawings in which:

FIGS. 1 and 2 illustrate a method by which the required lead may be calculated using a first embodiment of the invention;

FIG. 16 is a plan view of a fifth embodiment of the invention;

FIG. 17 is a side view of the fixed member of the embodiment shown in FIG. 16;

DETAILED DESCRIPTION OF THE PREFERRED EMBODIMENT

Figure 2:
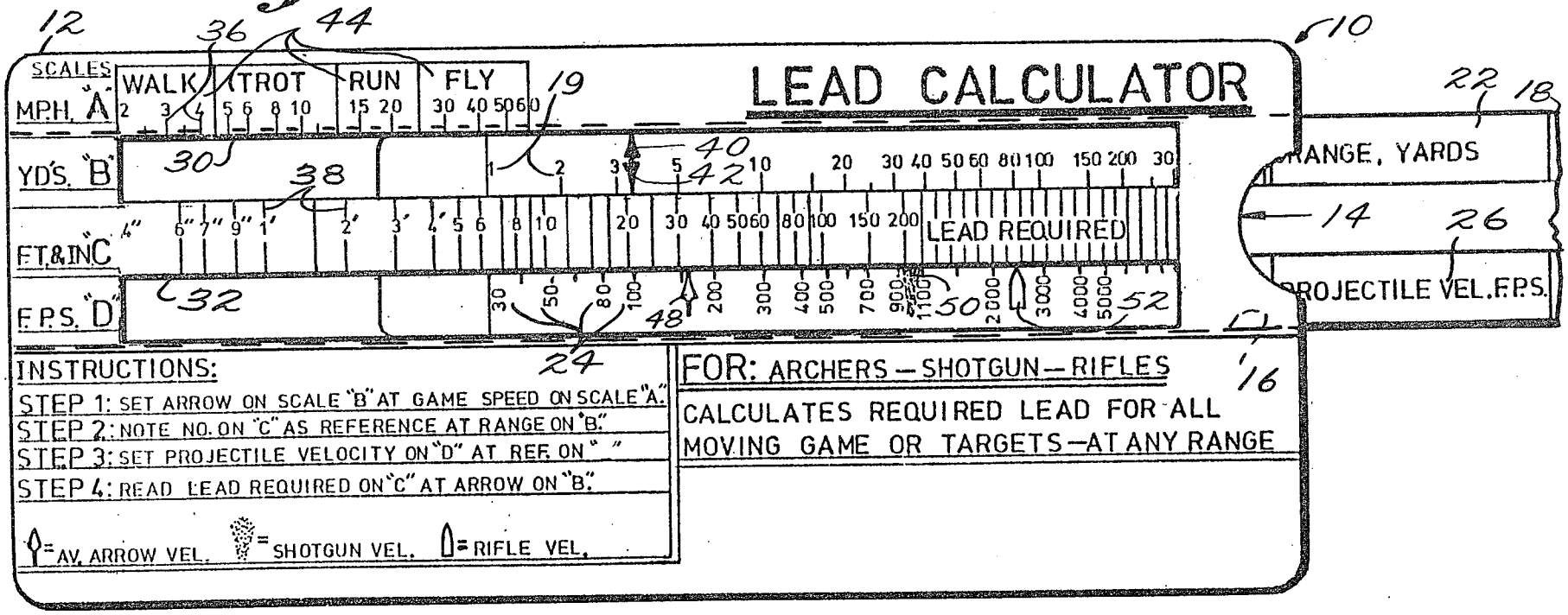
Figure 3:
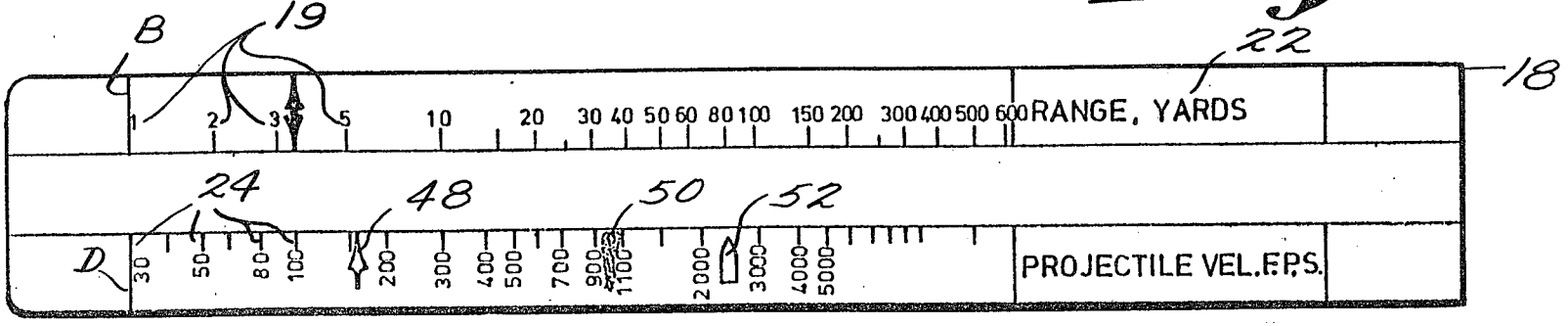
FIG. 3 illustrates the indicia on the slide member of the first embodiment of the invention.
Figure 5:
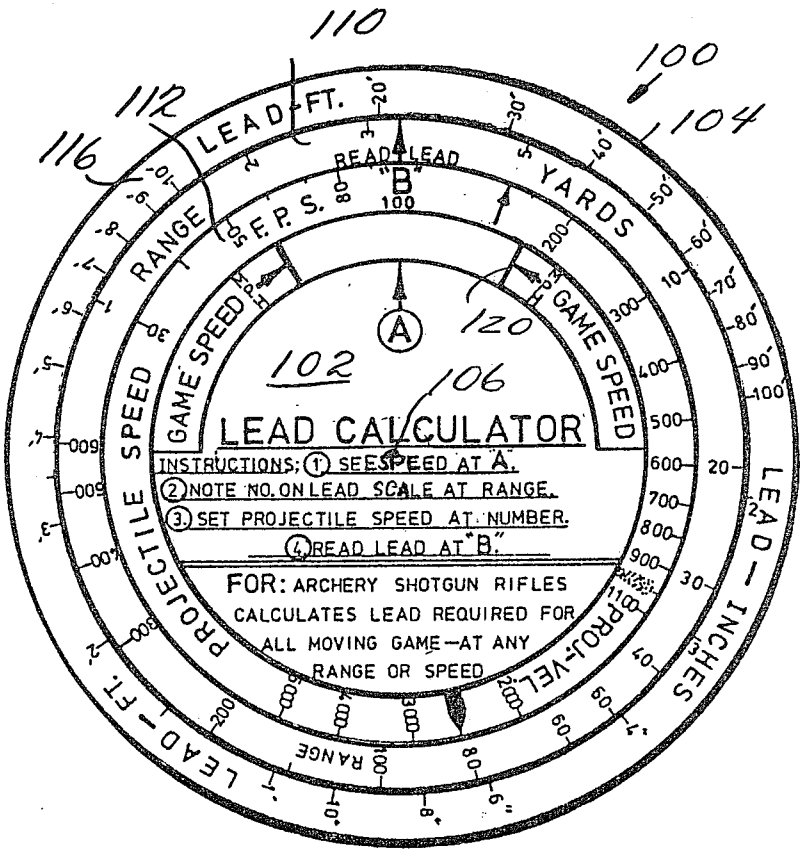
FIGS. 4 and 5 illustrate a method by which the required lead may be calculated using a second embodiment of the invention.
Figure 4:
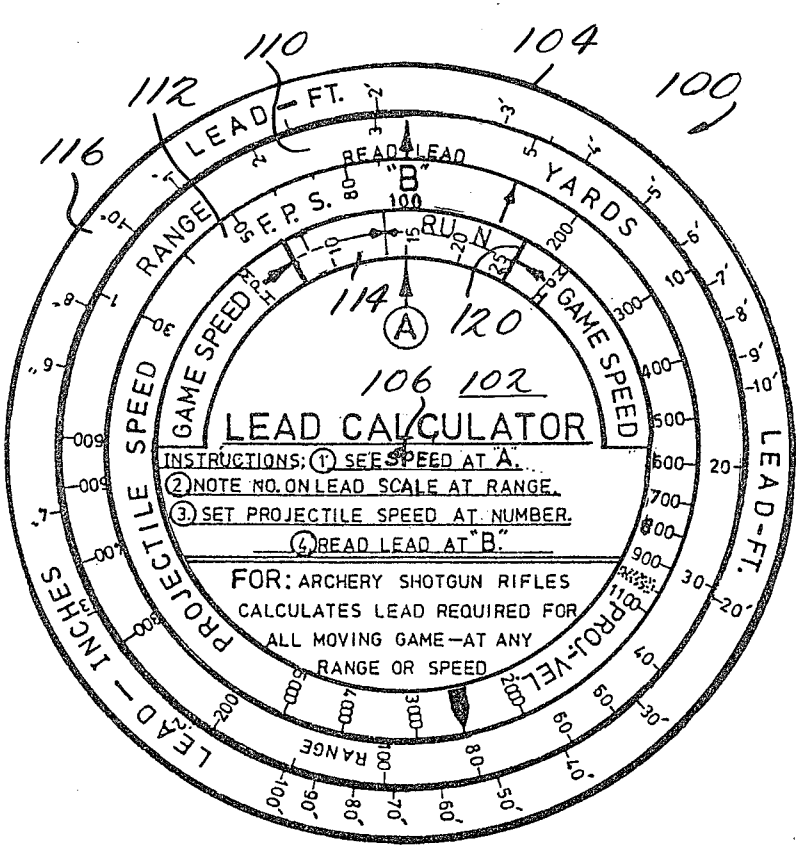
Figure 6:
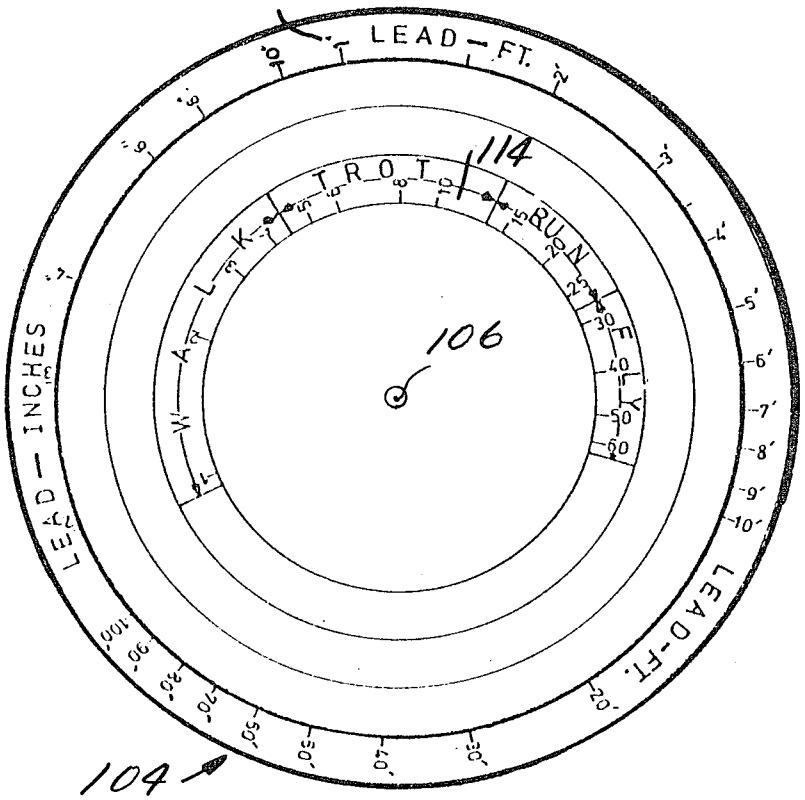
FIG. 6 illustrates the indicia on the fixed member of the second embodiment of the invention.
Figure 7:
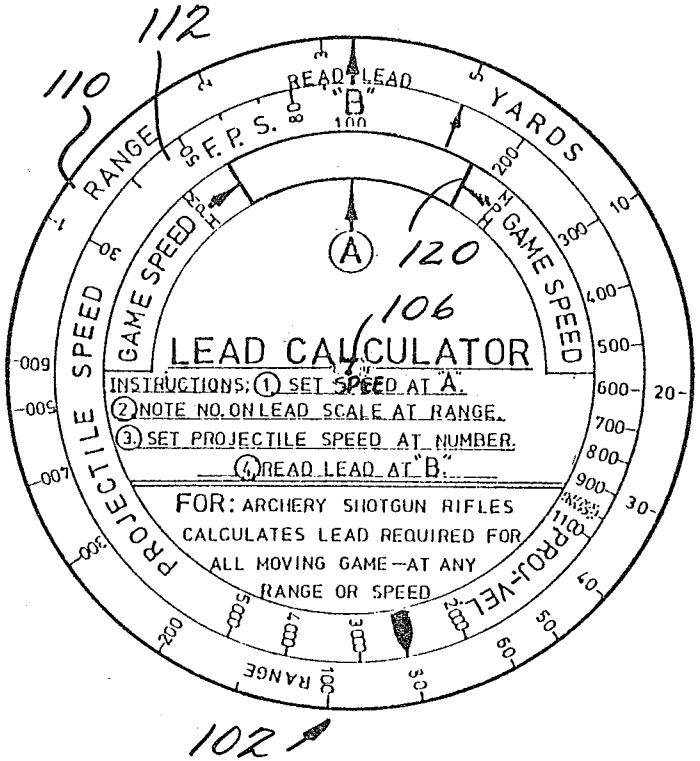
FIG. 7 illustrates the indicia on the slide member of the second embodiment of the invention.

The lead calculator of the present invention in a horizontal slide embodiment is shown in FIGS. 1 and 2. The lead calculator, generally designated by the numeral 10, comprises a fixed frame 12 having means defining a hollowed out area 14 (as represented by dashed lines 16) into which is inserted a slide member 18. Slide member 18 is shown individually in FIG. 3. Slide member 18 has disposed thereon two horizontal spaced apart logarithmic scales B and D. Scale B includes numerical indicia 19 corresponding to target range in units of distance, typically yards, as indicated by the verbal indicia 22 directly to the right of scale B. Scale D includes numerical indicia 24 corresponding to projectile speed, typically in units of feet per second, as indicated by the verbal indicia 26 to the right of scale D. In order that scales B and D may be visible, elongated horizontal openings 30 and 32 are suitably provided in fixed member 12 directly on top of scales D and B. Scales D and B are suitably designated as such on fixed member 12 adjacent to corresponding openings 30 and 32. Also disposed on fixed member 12 are a logarithmic scale A having numerical indicia 36 of target speed and a second logarithmic scale C with numerical indicia 38 corresponding to required lead. Scale A is suitably disposed directly above and horizontally aligned with opening 30 and scale B. Scale C is suitably horizontally disposed between and parallel aligned with openings 30 and 32 and scales B and D. A first marker is disposed on slide member 18 for marking a particular target speed, suitably arrow 40 located on scale B. A second marker is disposed on slide member 18 for marking a particular lead on scale C, suitably downward directed arrow 42 on scale B.

In order to use calculator 10 to determine the required lead, after determining the target (game) speed, the range and the projectile speed, slide member 18 is slid so that arrow 40 is set at the target (game) speed on scale A. The point on scale C adjacent to the determined range on scale B is then noted. The slide member 18 is again moved so that the projectile velocity on scale D is adjacent to the previously noted reference point on scale C and the required lead is then read on scale C adjacent to arrow 42 on scale B.

In order to assist persons unfamiliar with the speed of game in terms of miles per hour, verbal descriptions of the mode of movement 44 are disposed adjacent to particular ranges on scale A. The descriptive words used in the present embodiment are "walk," "trot," "run," and "fly." In carrying out the above described lead calculation procedure, arrow 40 may be set adjacent to the appropriate verbal indicia of mode of game movement 36 instead of the particular game speed on scale A.

In order to assist those unfamiliar with the normal speed of various projectiles used in target shooting and game hunting, pictorial indicia of various projectiles are disposed on scale D at the location corresponding to their normal projectile velocity. In the present embodiment pictorial representations of an arrow 48, shot 50, and a rifle bullet 52 are shown on scale D. In carrying out the last step of the above-described calculation, the pictorial representations 48, 50 and 52 may be utilized rather than the actual projectile velocity, depending on the projectile being utilized.

A sample calculation of lead is illustrated in FIGS. 1 and 2 for a target moving at 15 miles per hour, a target range of 50 yards, a projectile speed of 150 feet per second arrow marker 40 is set at 15 miles per hour on scale A and the point on scale C adjacent to 50 yards on scale B is noted (32 feet). As shown in FIG. 2, the indicia of 150 feet per second on scale D is set at the reference point on scale C (32 feet) and the lead is read off of scale C (21 feet).

The above-described calculation will be an accurate reflection of required lead assuming that the speed of the projectile and the speed of the target remain constant and the calculated range reflects the total distance traveled by the projectile before reaching the target if the logarithmic scales A, B, C, and D have correlated proportions and are correlated in location with markers 40 and 42, so that the two slide steps described above accomplish a multiplication and a division which marks the point on lead scale C representing the target speed times the target range divided by the projectile speed. The arrangements of logarithmic scales and markers which permit successive multiplication and division to be carried out on a slide type calculation are well known in the calculator art and all such arrangements are deemed to be within the scope of the present invention.

Arrows 40 and 42 may be placed at the same horizontal location on scale B, one vertically above the other, if the proportionate value at a given horizontal location on scales A and C is the same as the proportion of the values represented at the same horizontal location on scales B and D. As will be apparent from a close examination of FIG. 1, such equal proportions are utilized thereon—that proportion being 1:10 (sec-1). Thus, for example, the ratio one yard to thirty feet per second shown at one horizontal location on scales B and D, is equivalent to the ratio of 8.8 feet to 60 miles per hour shown at one horizontal location on scales C and A. When the scales are vertically aligned as described above, it is possible to determine required lead by only one movement of the slide member 18. In this configuration, if the projectile speed on scale D is made vertically aligned with the game or target speed on scale A, then the correct lead required will be vertically aligned with the correct range on scale B. This same principal also applies to all of the embodiments described in detail below.

An alternate embodiment of the invention is shown in FIGS. 4, 5, 6 and 7. This embodiment of the lead calculator designated by the numeral 100 has the form of a circular rule having a slide member 102 individually shown in FIG. 7 and a fixed member 104 individually shown in FIG. 6. Slide member 102 and fixed member 104 are suitably circular shaped discs concentrically rotatably mounted at their center by an axle member 106. The term "axle" is defined herein to include any suitable means for rotating two members about a axis. Slide member 102 suitably has a lesser diameter than fixed member 104. A logarithmic scale 110 having indicia corresponding to target range and a logarithmic scale 112 with indicia corresponding to projectile speed are disposed in circular concentric arcs about axle 106 on slide member 102. A logarithmic scale 114 corresponding to target (game) speed and a logarithmic scale 116 with indicia corresponding to required lead are disposed along circular concentric arcs about axle 106 on fixed member 104. The lead scale 116 is suitably disposed just inside the outside circumference of fixed member 104 and target speed scale 114 is suitably disposed so as to be visible through extended circular arc opening 120 which is located on movable slide member 102 inside target range scale 110 and projectile speed scale 112. Word indicia descriptive of target speed are disposed on target speed scale 114, pictorial indicia representative of projectile speed disposed on projectile speed scale 112, a target speed marker for marking particular target speed on scale 114 and a lead marker for marking a particular lead on scale 116 disposed on slide member 102 are arranged in a manner similar to the corresponding markers and indicia of the first (longitudinal slide) embodiment described above. The relationship between the four scales in the embodiment shown in FIGS. 4 through 7 are identical to those of the straight line scales of FIGS. 1 through 3 except that ranges of speed or distance are represented by angles of rotation in the second embodiment as opposed to lengths along the scales as in the first embodiment. The identical calculation as was described above and illustrated in FIGS. 1 and 2 is also illustrated for the second embodiment by FIGS 4 and 5.

Figure 8:
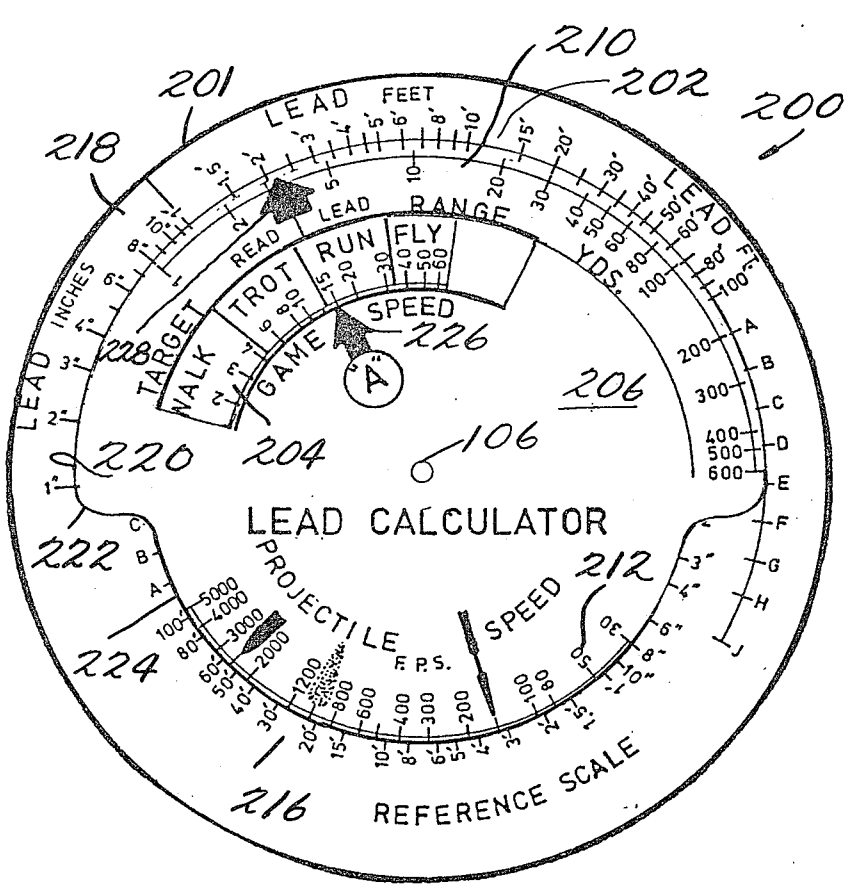
Figure 14:
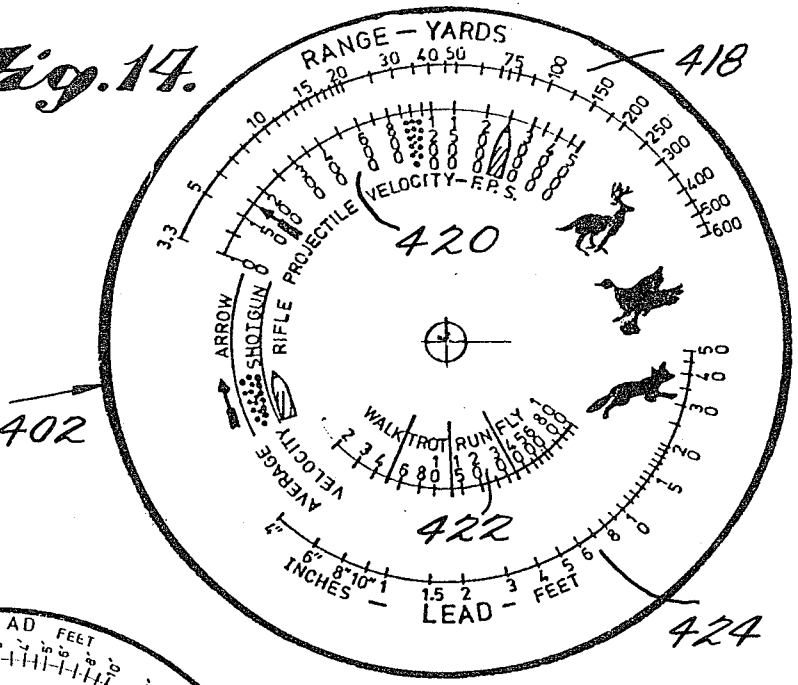
FIG. 14 illustrates the indicia on the fixed member of the fourth embodiment of the invention.
Figure 10:
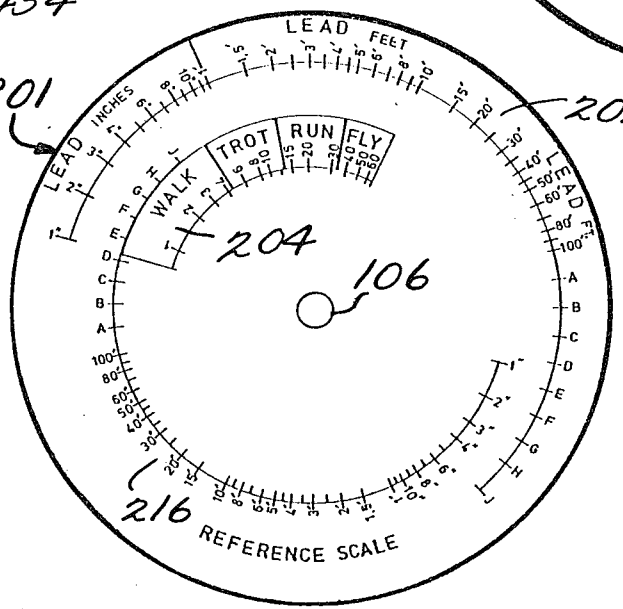
FIG. 10 illustrates the indicia on the fixed member of the third embodiment of the invention.
Figure 15:
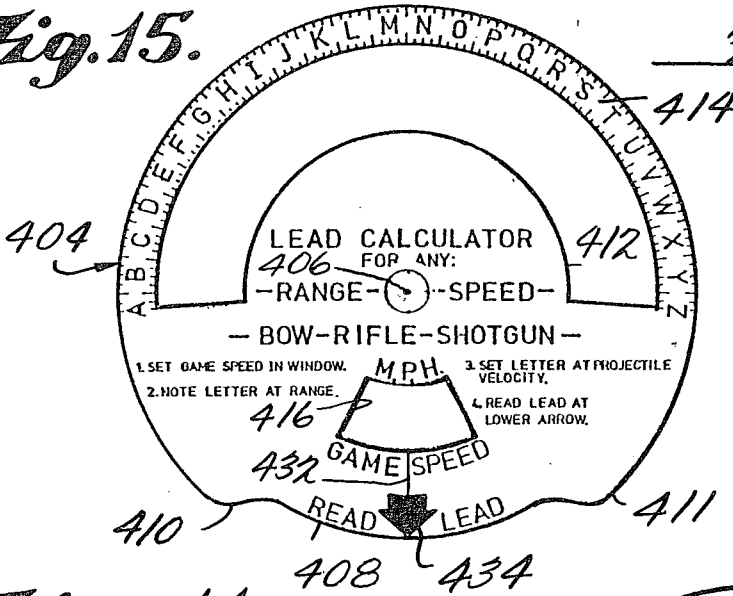
FIG. 15 illustrates the indicia on the movable member of the fourth embodiment of the invention.
Figure 11:
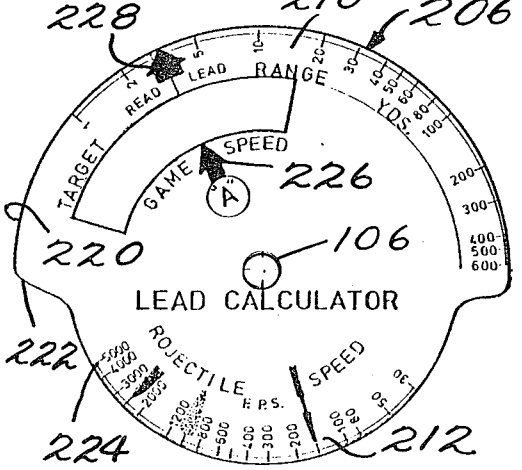
FIG. 11 illustrates the indicia on the movable member of the third embodiment of the invention.

A third embodiment of the present invention is illustrated by FIGS. 8 through 11. Referring to FIG. 8, the third embodiment 200 is very similar to the second, having a fixed disc-shaped member 201 with logarithmic circular arc shaped lead and target (game) speed scales 202 and 204 and a concentrically rotably mounted slide member 206 having a logarithmic target range scale 210 and projectile speed scale 212 disposed in a circular arc about axle 214. The third embodiment differs from the second embodiment primarily in having a fifth reference scale 216 similar to the range scale but disposed in a circular arc about the axle on the fixed member 201. In this embodiment, the lead scale suitably occupies the outer circumferential portion 218 of the fixed member 201. The slide member 206 has a first outer circumferential edge 220 on a portion of its outer perimeter 222 which may be rotated just inside of lead scale 202 on the fixed member 201 and a second circumferential edge 224 at a lesser radial distance from the axle which occupies the remainder of the perimeter of the slide member 206. The projectile speed scale 212 is disposed along the second circumferential edge 224 of the slide member 206 and the reference scale 216 is disposed on the fixed member at such a distance from axle 214 that the second circumferential edge 224 may be rotated immediately inside the reference scale 216. Game speed scale 204 is visible through arc shaped opening 225 in slide member 206.

Figure 9:
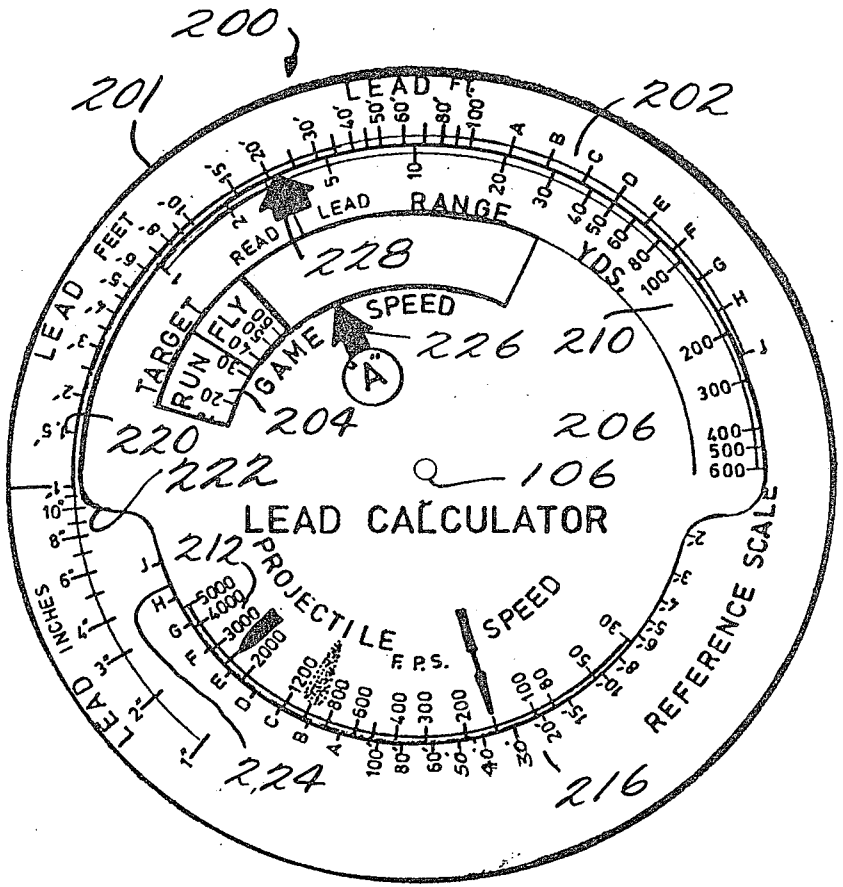
FIGS. 8 and 9 illustrate a method by which lead may be calculated using a third embodiment of the invention.

In order to calculate the required lead using the third embodiment of the lead calculator, after determining the projectile speed, the game or target speed and the range, target speed marker 226 is set at the determined target speed. The value on the lead scale adjacent to the determined range is then noted and the determined projectile speed is set at the noted value on the reference scale 216. The lead is then read adjacent to lead marker 228 on the lead scale 202. This procedure is illustrated in FIGS. 8 and 9 for a target speed of 15 miles per hour, a projectile speed of 150 feet per second and a range of 50 yards. The determined lead, as in the altenate embodiments described above, is calculated at 21 feet.

A fourth embodiment of the invention is shown in FIGS. 12, 13, 14 and 15. This embodiment of the lead calculator designated by the numeral 400 has the form of a circular rule having a fixed member 402 individually shown in FIG. 14 and a slide member 404 individually shown in FIG. 15. Fixed member 402 and slide member 404 are suitably circular shaped discs concentrically rotatably mounted together at their centers by an axle member 406. Slide member 404 suitably has a lesser diameter than fixed member 402 and an arc shaped indented edge 408 forming a portion of its outside edge 410. The remainder of outside edge 410 is designated by the numeral 411. Slide member 404 also has an extended opening 412 in the shape of a circular arc near a portion of the circular edge 411. A reference scale 414 suitably a linear scale with alphabet reference markings, is disposed on member 404 in a circular arc between opening 412 and edge 411. A second circular arc shaped opening 416 in member 404 near edge 408. Reference scale 414, opening 412 and 416 and indented edge 408 are all circular arc shaped and have their center of rotation at axle 406. On fixed member 402 a logarithmic scale 418 having indicia corresponding to target range, a logarithmic scale 420 with indicia corresponding to projectile speed, a logarithmic scale 422 with indicia corresponding to target (game) speed and a logarithmic scale 424 with indicia corresponding to required lead are disposed along circular concentric arcs about axle 406. Range scale 418 is arranged to be visible adjacent to edge 410, projectile velocity scale 420 is arranged to be visible through opening 412, target speed scale 422 is arranged to be visible through opening 416 and required lead scale 424 is arranged to be visible along edge 408. As in the previously described embodiments of the present invention, word indicia descriptive of target (game) speed are disposed on target speed scale 422 and pictorial indicia representative of projectile speed are disposed on projectile speed scale 420. A target speed marker 432 is disposed adjacent opening 416 for marking the target speed on scale 422 and marker 434 is disposed on member 404 adjacent indented edge 408 for marking the require lead on scale 424.

Figure 13:
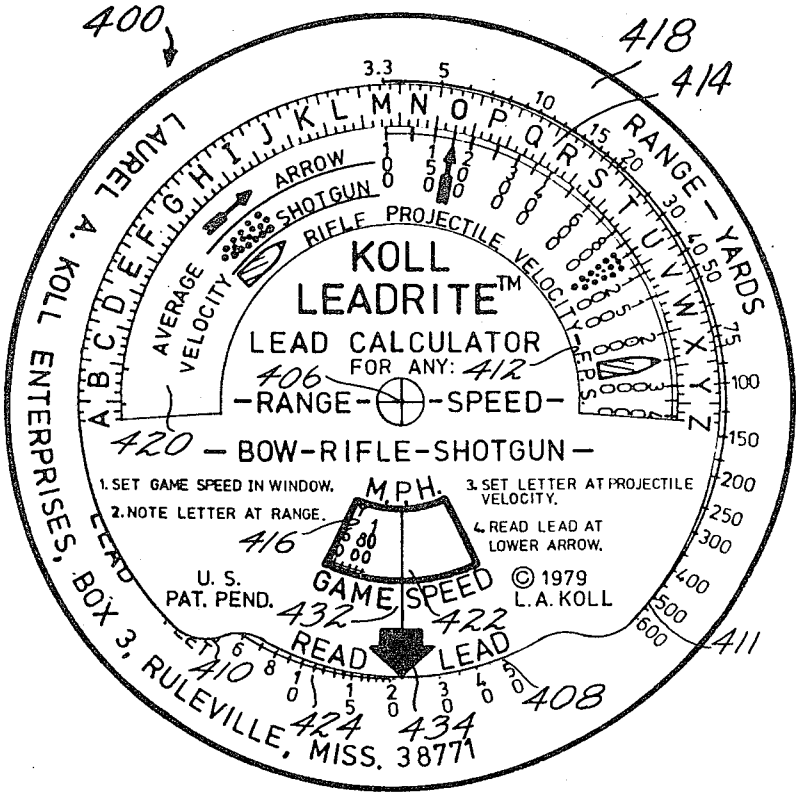
FIGS. 12 and 13 illustrate the method by which the required lead may be calculated using a fourth embodiment of the invention.
Figure 12:
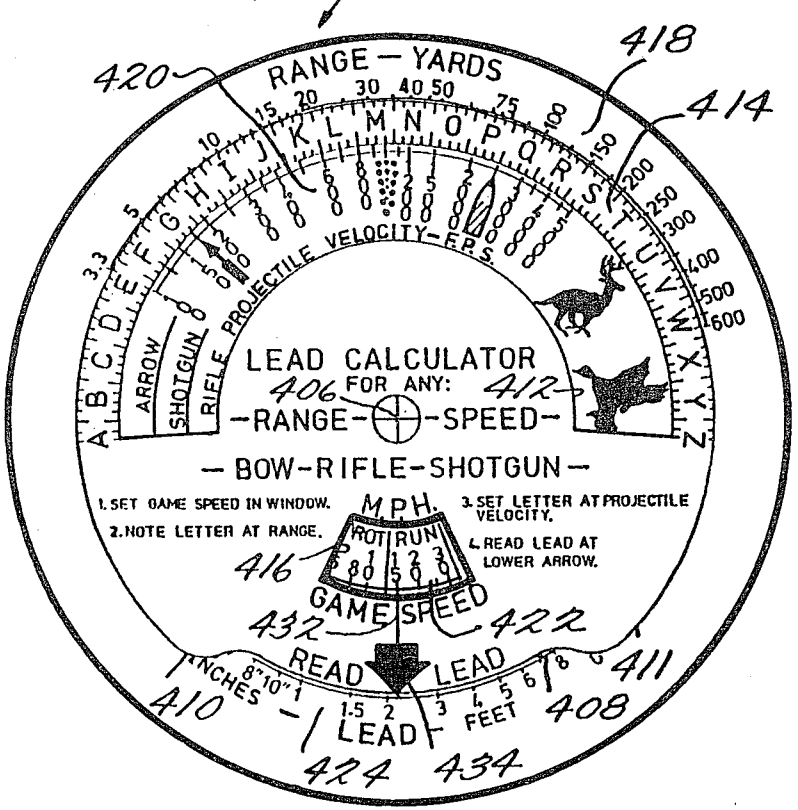

In order to calculate the required lead using the fourth embodiment of the lead calculator, after determining the projectile speed, the target speed and the range, target speed marker 432 is set at the determined target speed on scale 422. The reference marking on the reference scale 414 adjacent to the determined range is then noted and the determined projectile speed is set at the noted reference marking. The lead is then read adjacent to the lead marker 434 on the lead scale 424. It will be noted reference scale 414 serves a similar function as a cursor on conventional sliderules. This procedure is illustrated in FIGS. 12 and 13 for a target speed of 15 miles per hour, a projectile speed of 150 feet per second and a range of 50 yards. The determined lead, as in the alternate embodiments described above, is calculated at 21 feet.

The fifth embodiment of the present invention, illustrated in FIGS. 16 and 17, is specifically designed for calculating required lead for a single given projectile speed but requires only one slide step to make the calculation. Referring to FIG. 16, the fifth embodiment of the present invention, generally designated by the numeral 500, is shown to include a fixed member 502 having a means defining a hollowed out area 504 (as represented by dashed lines 506) into which is inserted a slide member 508. Also included in the fifth embodiment of the present invention is attachable membe 510 which may be attached and detached from fixed member 502 as by the use of an adhesive as will be described. Fixed member 502 suitably has a front surface 512 including an upper front surface 514 having a lower edge 515 and a lower front surface 516 having an upper edge 517 separated by a longitudinally extended opening 518. Slide member 508 has disposed thereon a logarithmic scale 520 with numerical indicia corresponding to target range in units of distance, typically yards, as indicated by the verbal indicia 522 directly to the right of range scale 20. Horizontally disposed on fixed member lower front surface 516 along edge 517 is a logarithmic scale 524 with numerical indicia corresponding to target speed, in units of miles per hour, as indicated by the verbal indicia 526 directly to the left of target speed scale 524. Attachable member 510 suitably composed of cardboard or a plastic material, has disposed thereon a logarithmic scale 528 with numerical indicia corresponding to required lead in units of distance, typically feet, as indicated by the verbal indicia 530 directly to the right of lead scale 528. Range scale 520 is disposed on slide member 508 so as to be visible through opening 518 in fixed member 502. A target (game) speed marker, suitably arrow 532, is also disposed on slide member 508, visible through opening 518 along edge 517 of surface 516 along which target speed scale 524 is disposed.

In order to attach attachable member 510 to fixed member 502 so as to permit calculations of required lead for a particular projectile speed, it is necessary only to align the lead scale 528, the range scale 520 and the target speed scale 524 so that by using the numerical values on the three scales directly adjacent to marker 532, the target speed times the range divided by the projectile speed of the arm to be used is equal to the lead value adjacent to marker 532. Thus, referring to FIG. 16, with the marker 532 being adjacent to a range value of 40 yards and being set at 30 miles per hour on the target speed scale 524 and for a projectile speed of 2500 feet per second, the 2.1 foot marker on the lead scale would be aligned with the 30 miles per hour mark on the target speed scale 524. With the attachable member 510 so attached to the fixed member 502, once the range and target speed have been determined, the marker 532 need only be aligned with the determined target speed and the lead read off adjacent to the determined range.

The simplified calculations of the fifth embodiment may of course also be accomplished with a two member device, all of the scales being permanently disposed thereon, the device being manufactured for use in making lead calculations based on a single projectile speed.

Although six particular embodiments of the invention have been disclosed in detail above, for illustrative purposes, it will be understood that variations or modifications of the disclosure which lie within the scope of the appended claims are fully contemplated. For example, there are a multitude of possible arrangements of the four logarithmic scales of embodiments 1, 2, 3 and 4, the reference scales in embodiments 3 and 4 and the three logarithmic scales of embodiment 5 which will make similar calculations of lead. Division steps in the calculation of lead may also be carried out using logarithmic scales disposed in a reversed direction. Also, any of the three scales utilized in the fifth embodiment may be made detached or detachable from the fixed member with the same calculational results being possible. It will also be appreciated by those skilled in the art, that various other calculating devices such as nanograms and slide charts can be adapted to make similar calculations of lead by using properly arranged logarithmic scales and indicia as described above.

What is claimed is:

1. A lead calculator for calculating the required lead in predetermined units of linear distance as a function of target speed, target range, and projectile speed for shooting at a moving target comprising:

a fixed member and a slide member moveable with respect to said fixed member; and at least four scales including a first logarithmic scale with indicia representing target range along a line of sight from the projectile launching point to the point of intended impact, a second logarithmic scale with indicia representing target speed, a third logarithmic scale with numerical indicia representing required lead; and a fourth logarithmic scale with indicia representing projectile speed;

said first, second, third and fourth scales being disposed on at least one of said fixed and slide members in physical proximity so that they are correlated;

a non-logarithmic reference scale disposed on the other one of said members;

said first and third scales having indicia of differing predetermined units of linear distances;

said slide member having indicia means disposed thereon for marking the calculation of required lead in terms of distance, perpendicular to the line of sight;

said calculation requiring moving said slide member relative to said fixed member at least one time so as to align said first, second and third scales so that the required lead may be readily determined.

2. A lead calculator for calculating the required lead when shooting a projectile at a moving target, as a function of three parameters, the parameters including target speed, target range and projectile speed, the calculator comprising:

five scales including a first logarithmic scale having corresponding indicia designating quantitative representations of target speed, a second logarithmic scale having corresponding indicia designating quantitative representations of target range, a third logarithmic scale having corresponding indicia designating quantitative representations of projectile speed a fourth logarithmic scale having corresponding indicia designating quantitative representations of required lead and a reference scale;

a first member;

a second member slidable in relation to said first member;

said first, second, third and fourth logarithmic scales being disposed on said first members;

said reference scale being disposed on said second member;

said first through fourth scales having relative positions and such relative proportions that the product of the target speed and the target range divided by the projectile speed may be readily determined by moving said second member in relation to said first member to a first relative position determinable from the value of two of said parameters, noting a first location on said reference scale adjacent a location on one of said first through fourth scales corresponding to the value of one of said parameters and moving said first member to a second relative position determinable from said noted first location and the value of said one of said parameters.

3. A lead calculator as is claim 2 wherein:

said second member further includes first means for marking a particular target speed on said first scale and second means for marking the value of the lead parameter on said fourth scale;

said first relative position being defined by said first marking means marking the value of the target speed parameter on said first scale;

said first location on said reference scale being adjacent the location of said second scale corresponding to the value of the range parameter; and said second relative position being defined by said first location on said reference scale being adjacent the indicia representative of the value of the projectile speed parameter on said third scale.

4. A lead calculator as in claim 3 further comprising an axle member, said first and second members being mounted on said axle member for rotation about a common axis.

5. A lead calculator as in claim 4 wherein each of said scales are disposed in circular arcs, said arcs being concentrically disposed on said members about said axis.

6. A lead calculator as in claim 5 wherein said second member has at least two arcuate windows for viewing at least two of said first, second, third and fourth scales.

7. A lead calculator as in claim 6 wherein the scales viewable through said arcuate window includes said third scale, said calculator further comprising:

a plurality of pictorial representations of particular corresponding projectiles disposed on said third scale at places corresponding to the speed at which said corresponding projectiles are normally fired so as to be visible through one of said windows; and a legend, formed on said first member adjacent said third scale and visible through said one window for verbally identifying said plurality of projectiles.

8. A lead calculator as in claim 2 further comprising at least two pictorial representations of particular corresponding projectiles disposed on said third scale in a place corresponding to the speed at which said corresponding projectile is normally fired.

9. A lead calculator as in claim 8 wherein said at least two pictorial representations have the shapes of said corresponding projectiles.

10. A lead calculator as in claim 2 wherein said reference scale is linear.

11. A lead calculator as in claim 2 further comprising verbal descriptive indicia formed on said first scale, said verbal descriptive indicia corresponding to predetermined intervals of numerical indicia.

12. A lead calculator as in claim 11 wherein said moving target comprises game, said verbal descriptive indica including a plurality of indicia qualitatively descriptive of the speed of said game.

13. A lead calculator as in claim 11 wherein said verbal descriptive indicia include "walking," "trotting," "running" and "flying".

14. A device for calculating the required lead when shooting a projectile at a moving game, as a function of game speed, game range and projectile speed, comprising:

a first logarithmic scale having numerical indicia associated therewith corresponding to game speed;

a second logarithmic scale having numerical indicia associated therewith corresponding to the required lead;

a third logarithmic scale having numerical indicia associated therewith corresponding to game range;

a fourth logarithmic scale having numerical indicia associated therewith corresponding to projectile speed;

descriptive indicia formed on said first logarithmic scale for designating predetermined intervals of game speed corresponding to particular modes of movement of said game such as walking, trotting, running and flying; and a reference scale disposed on a first member;

said first, second, third and fourth scales and said descriptive character indicia being formed on a second member and disposed in physical proximity with each other so that they are correlated, the correlated numerical value associated with the required lead scale being readily determinable if the correlated numerical value associated with the projectile speed scale, the correlated numerical value associated with the game range and either the correlated numerical value or the interval descriptive indicia formed on the game speed scale are known.

15. A device for calculating the required lead when shooting a projectile at a moving target, as a function of target speed, target range and projectile speed, comprising:

at least one member;

four scales including a first logarithmic scale having numerical indicia associated therewith corresponding to target speed, a second logarithmic scale having numerical indicia associated therewith corresponding to the required lead, a third logarithmic scale having numerical indicia associated therewith corresponding to target range, and a fourth logarithmic scale corresponding to projectile speed; and a plurality of indicia respectively corresponding to different projectiles disposed at predetermined locations on said third scale corresponding to the normal speed of said projectiles when they are shot;

said first, second, third and fourth scales being formed on said at least one member and disposed in physical proximity with each other so that they are correlated, the correlated numerical value associated with the required lead scale being readily determinable if the correlated numerical value associated with the target range scale, the correlated numerical value associated with the target speed scale and the particular projectile being shot are known.

16. A device as in claim 15 further comprising a plurality of word indicia corresponding to separate intervals of target speed disposed at corresponding locations adjacent said first scale.

17. A device as in claim 14 or claim 15, wherein the target speed is scaled in units of miles/hour, the required lead is scaled in units of feet, the target range is scaled in units of yards and the projectile speed is scaled in units of feet per second.

18. A method for calculating required lead in predetermined units of linear distance as a function of target speed, target range and projectile speed for shooting a projectile at a moving target, utilizing a first member; a second member slidable in relation to said first member; a first logarithmic scale having indicia representing target range along a line of sight from the projectile launching point to the point of intended impact, a second logarithmic scale having indicia representing target speed; a third logarithmic scale having indicia representing required lead in terms of distance perpendicular to said line of sight; and a fourth logarithmic scale representing projectile speed, said scales being disposed on at least one of said first and second members in such proximity to each other that they are correlated; and non-logarithmic marking indicia disposed on said second member for marking the calculation of required lead when said second member is moved relative to said first member, the method comprising the step of:

sliding said slide member in relation to said first member so as to align said marking indicia disposed on said second member with the numerical indicia corresponding to the required lead, the target speed and the target range, the required lead being readily determinable thereby.

19. A method for calculating the required lead when shooting a projectile at a moving target as a function of three parameters, the parameters being target speed, target range and projectile speed, utilizing a calculator comprising at least five scales including a first scale having corresponding indicia of target speed, a second logarithmic scale having corresponding indicia designating quantitative representations of target range, a third logarithmic scale having corresponding indicia designating quantitative representations of projectile speed, and a fourth logarithmic scale having corresponding indicia designating quantitative representations of required lead; said lead indicia and said target indicia having differing units of length, said target speed indicia and said projectile speed indicia having differing units of speed; the calculator further comprising a first member and a second member slidable in relation to said first member, said first through fourth logarithmic scales being disposed on said first member and being structurally correlated a reference scale formed on said second member; said method comprising the steps of:

(1) sliding said second member in relation to said first member so as to determine a point on said reference scale corresponding to the product of the target speed and the target range; and (2) sliding said second member in relation to said point on said first member in order to determine a value equal to the product of target speed and target range divided by the projectile speed.

20. A method as in claim 19 wherein step (2) comprises the step of sliding said second member so as to align said point with the pictorial representation of the particular type of projectile being shot disposed on said third scale at a position corresponding to the normal speed of said type of projectile when shot.

21. A method of calculating required lead, as a function of three parameters including target speed, target range and projectile speed, when shooting at a movable target with any of a variety of projectiles utilizing a calculating device comprising at least five scales including a first logarithmic scale having corresponding indicia designating quantitative representations of target speed, a second logarithmic scale having corresponding indicia designating quantitative representations of target range, a third logarithmic scale having corresponding indicia designating quantitative representations of projectile speed, a fourth logarithmic scale having corresponding indicia designating quantitative representations of required lead and a reference scale; a first member; a second member slidable in relation to said first member; said first, second, third and fourth logarithmic scales being structurally correlated and being disposed on said first member, said second member having disposed thereon said reference scale, said method comprising the steps of:

(1) moving said second member in relation to said first member to a first relative position determinable from the value of one of said three parameters, a first location on said reference scale there being disposed adjacent a second location on said first member, said second location on one of said first, second or fourth logarithmic scales corresponding to the value of a second one of said three parameters; and (2) moving said first member to a second relative position determinable from said noted first location and the value of a third one of said three parameters.

22. A method as in claim 19 or claim 21 wherein the target comprises game, said first scale has marked thereon a plurality of designated intervals of speed of the game and verbal indicia, correlated to said intervals, corresponding to modes of movement of the game, such as "walking," "trotting," "running" and "flying", one of the step (1) and step (2) including the steps of aligning a point on said first scale within the interval of speed corresponding to the actual mode of movement of the game with a point on one of the second or fourth scales.

* * * * *